US007275592B2

(12) United States Patent
Davis

(10) Patent No.: US 7,275,592 B2
(45) Date of Patent: Oct. 2, 2007

(54) OIL WELL PUMP APPARATUS

(76) Inventor: Raymond C. Davis, 8045 Ilene La., Lake Charles, LA (US) 70605

( * ) Notice: Subject to any disclaimer, the term of this patent is extended or adjusted under 35 U.S.C. 154(b) by 692 days.

(21) Appl. No.: 10/372,533

(22) Filed: Feb. 21, 2003

(65) Prior Publication Data

US 2006/0153695 A1 Jul. 13, 2006

(51) Int. Cl.
*E21B 43/00* (2006.01)
*F04B 47/12* (2006.01)
*F04B 25/00* (2006.01)

(52) U.S. Cl. ..... 166/105.2; 166/105.3; 166/105.4; 166/202; 166/372; 417/60; 417/246; 417/423.9

(58) Field of Classification Search ..... 166/369, 166/370, 372, 381, 383, 68, 68.5, 105, 105.1, 166/105.2, 105.3, 105.4, 106, 202, 153, 177.3; 417/56, 60, 245, 423.3, 423.9
See application file for complete search history.

(56) References Cited

U.S. PATENT DOCUMENTS 2,263,144 A * 11/1941 Scott Bertha Britton .... 417/435
2,658,457 A * 11/1953 Harbison ..... 166/105.2
2,676,547 A * 4/1954 Knox ..... 417/60
2,737,119 A * 3/1956 Hill ..... 417/326
3,273,501 A 9/1966 Tothero
3,420,183 A * 1/1969 Hart ..... 166/105.1
3,506,068 A * 4/1970 Brown et al. ..... 166/153
3,741,298 A * 6/1973 Canton ..... 166/105
3,861,471 A * 1/1975 Douglas ..... 166/369
3,968,839 A * 7/1976 Swihart, Sr. ..... 166/250.07
4,007,784 A * 2/1977 Watson et al. ..... 166/170
4,193,746 A 3/1980 Aman, Jr.
4,227,573 A * 10/1980 Pearce et al. ..... 166/153
4,239,458 A * 12/1980 Yeatts ..... 417/60

(Continued)

OTHER PUBLICATIONS

Positive Displacement—Geroto Pumps, Crane Aerospace, www.learromec.com Feb. 18, 2003.

(Continued)

*Primary Examiner*—Jennifer H Gay
(74) *Attorney, Agent, or Firm*—Garvey, Smith, Nehrbass & North, L.L.C.; Charles C. Garvey, Jr.

(57) ABSTRACT

An oil well pumping apparatus for pumping oil from a well to a wellhead provides a tool body that is sized and shaped to be lowered into the production tubing string of the oil well. A working fluid is provided that can be pumped into the production tubing. A prime mover is provided for pumping the working fluid. A flow channel into the well bore enables the working fluid to be circulated from the prime mover via the production tubing to the tool body at a location in the well and then back to the wellhead area. A pumping mechanism is provided on the tool body, the pumping mechanism including first and second gerotors. The first gerotor is driven by the working fluid. The second gerotor is rotated by the first gerotor. The two gerotors are connected with a common shaft. The tool body has flow conveying portions that mix the working fluid and the produced oil as the oil is pumped. The pumping mechanism transmits the commingled fluid of oil and working fluid to the wellhead area where they are separated and the working fluid recycled.

25 Claims, 9 Drawing Sheets

U.S. PATENT DOCUMENTS 4,296,810 A * 10/1981 Price ..... 166/265
4,540,347 A 9/1985 Child
4,624,312 A * 11/1986 McMullin ..... 166/155
4,828,036 A * 5/1989 Simmons ..... 166/369
4,889,473 A * 12/1989 Krueger ..... 417/56
4,986,739 A 1/1991 Child
5,127,803 A * 7/1992 Walter ..... 417/57
5,462,115 A * 10/1995 Belden et al. ..... 166/177.3
5,562,433 A * 10/1996 Cholet et al. ..... 418/47
5,611,397 A * 3/1997 Wood ..... 166/68
5,813,457 A * 9/1998 Giroux et al. ..... 166/153
5,845,709 A * 12/1998 Mack et al. ..... 166/302
5,868,554 A * 2/1999 Giacomino et al. ..... 417/56
6,070,661 A * 6/2000 Kennedy et al. ..... 166/106
6,082,451 A * 7/2000 Giroux et al. ..... 166/72
6,082,452 A * 7/2000 Shaw et al. ..... 166/105.5
6,113,360 A 9/2000 Yu et al.
6,123,149 A * 9/2000 McKinzie et al. ..... 166/266
6,135,203 A * 10/2000 McAnally ..... 166/105.2
6,138,758 A * 10/2000 Shaw et al. ..... 166/265
6,148,923 A * 11/2000 Casey ..... 166/372
6,167,965 B1 * 1/2001 Bearden et al. ..... 166/250.15
6,170,573 B1 * 1/2001 Brunet et al. ..... 166/153
6,209,637 B1 * 4/2001 Wells ..... 166/153
6,328,111 B1 * 12/2001 Bearden et al. ..... 166/381
6,361,272 B1 * 3/2002 Bassett ..... 415/121.1
6,412,563 B1 * 7/2002 William St. Clair et al. .... 166/372
6,454,010 B1 * 9/2002 Thomas et al. ..... 166/369
6,615,926 B2 * 9/2003 Hester et al. ..... 166/370
6,644,399 B2 * 11/2003 Abbott et al. ..... 166/68
6,698,521 B2 * 3/2004 Schrenkel et al. ..... 166/369
2002/0134554 A1 * 9/2002 Schrenkel et al. ..... 166/372
2003/0141051 A1 * 7/2003 Abbott et al. ..... 166/53
2004/0035571 A1 * 2/2004 Abbott et al. ..... 166/53
2004/0144545 A1 * 7/2004 Lauritzen et al. ..... 166/369

OTHER PUBLICATIONS

Gerotor Pumping Element CAD/CAM Software, Gerotor Design Studio, www.gerotors.co.uk Feb. 18, 2003.

* cited by examiner

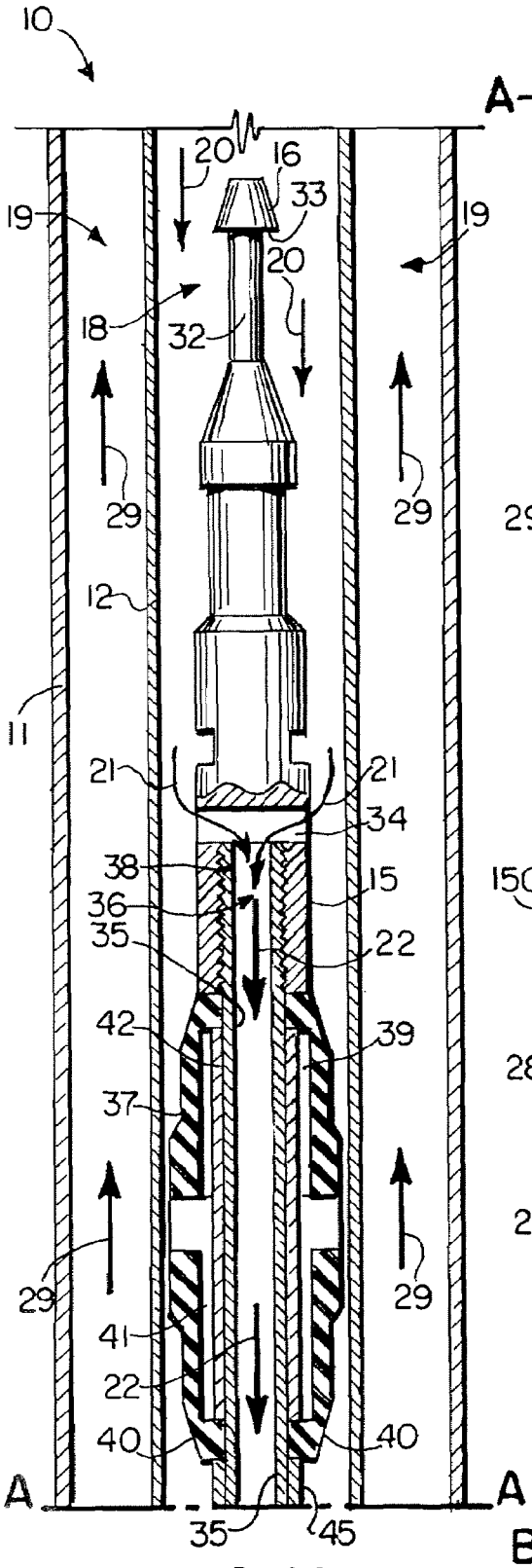
FIG. IA.
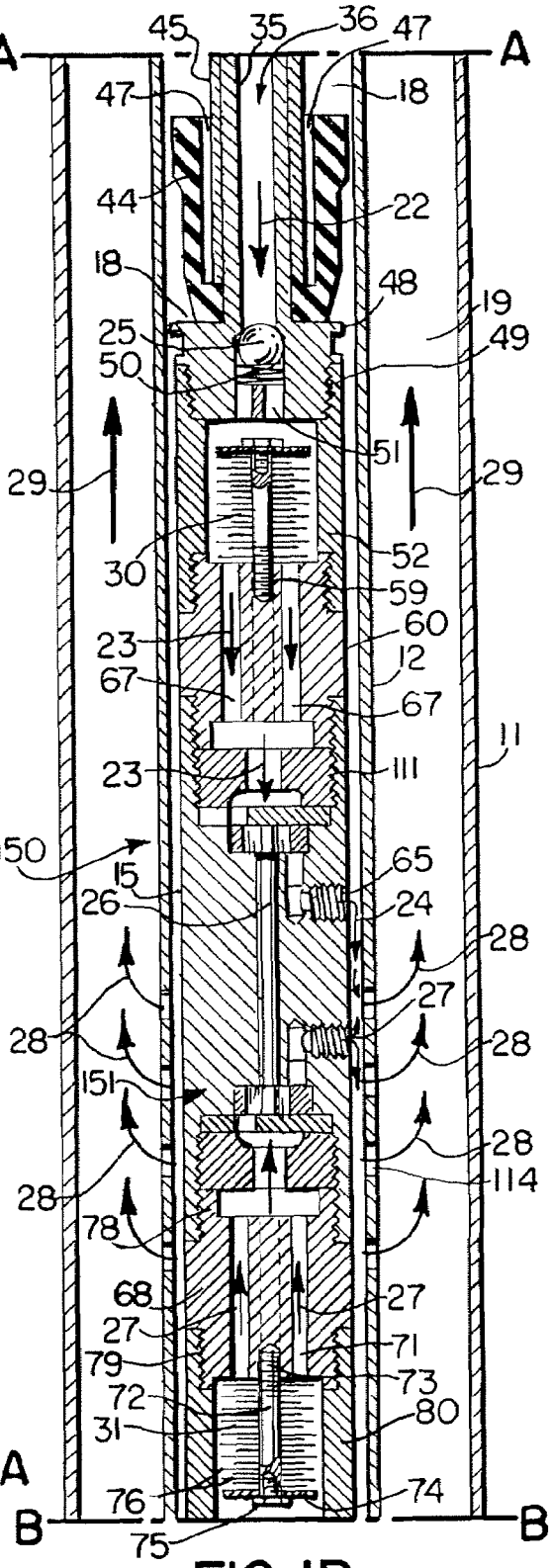
FIG. IB.

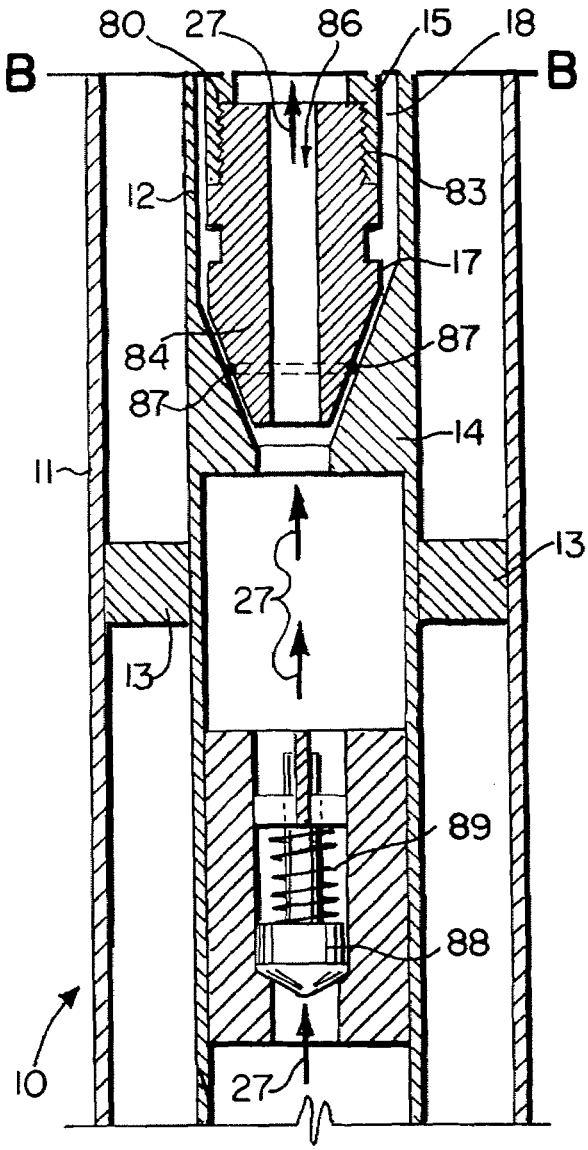
FIG. IC.
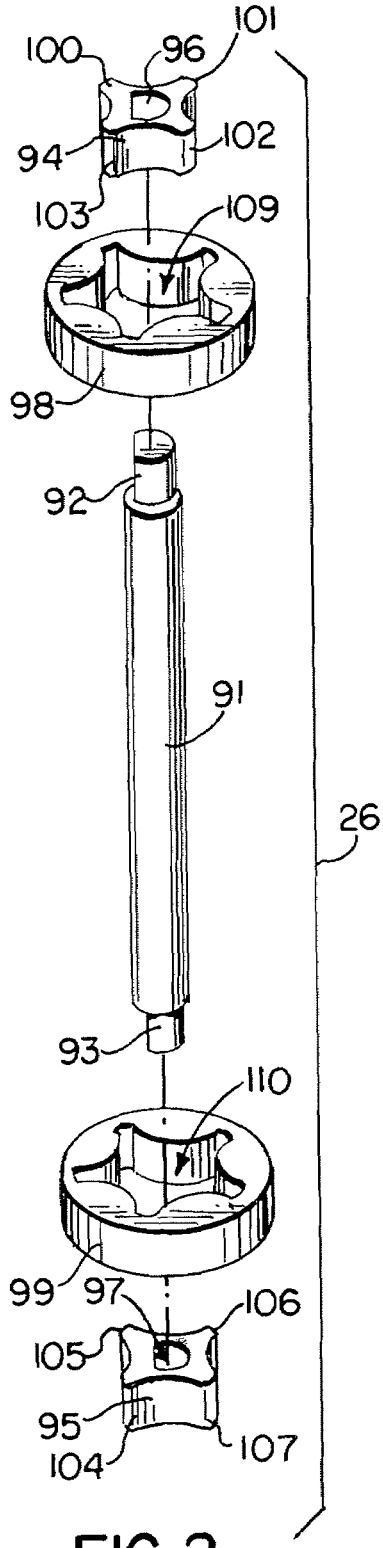
FIG. 2.

OIL WELL PUMP APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well pumps. More particularly, the present invention relates to a downhole oil well pump apparatus that uses a circulating working fluid to drive a specially configured pump that is operated by the working fluid and wherein the pump transmits oil from the well to the surface by commingling the pumped oil with the working fluid, oil and the working fluid being separated at the wellhead or earth's surface. Even more particularly, the present invention relates to an oil well pump that is operated in a downhole cased, production pipe environment that utilizes a pump having a single pump shaft that has gerotor devices at each end of the pump shaft, one of the gerotor devices being driven by the working fluid, the other gerotor device pumping the oil to be retrieved.

2. General Background of the Invention

In the pumping of oil from wells, various types of pumps are utilized, the most common of which is a surface mounted pump that reciprocates between lower and upper positions. Examples include the common oil well pumpjack, and the Ajusta® pump. Such pumps reciprocate sucker rods that are in the well and extend to the level of producing formation. One of the problems with pumps is the maintenance and repair that must be performed from time to time.

BRIEF SUMMARY OF THE INVENTION

The present invention provides an improved pumping system from pumping oil from a well that provides a downhole pump apparatus that is operated with a working fluid that operates a specially configured pumping arrangement that includes a common shaft. One end portion of the shaft is a gerotor that is driven by the working fluid. The other end portion of the shaft has a gerotor that pumps oil from the well. In this arrangement, both the oil being pumped and the working fluid commingle as they are transmitted to the surface. A separator is used at the earth's surface to separate the working fluid (for example, water) and the oil.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 1A, 1B, 1C are a sectional elevation view of the preferred embodiment of the apparatus of the present invention, wherein the drawing 1A matches to the drawing 1B at match lines A-A and the drawing 1B matches to the drawing 1C at match lines B-B;

FIG. 2 is a partial exploded perspective body of the preferred embodiment of the apparatus of the present invention showing some of the pumping components;

DETAILED DESCRIPTION OF THE INVENTION

Figure 3:
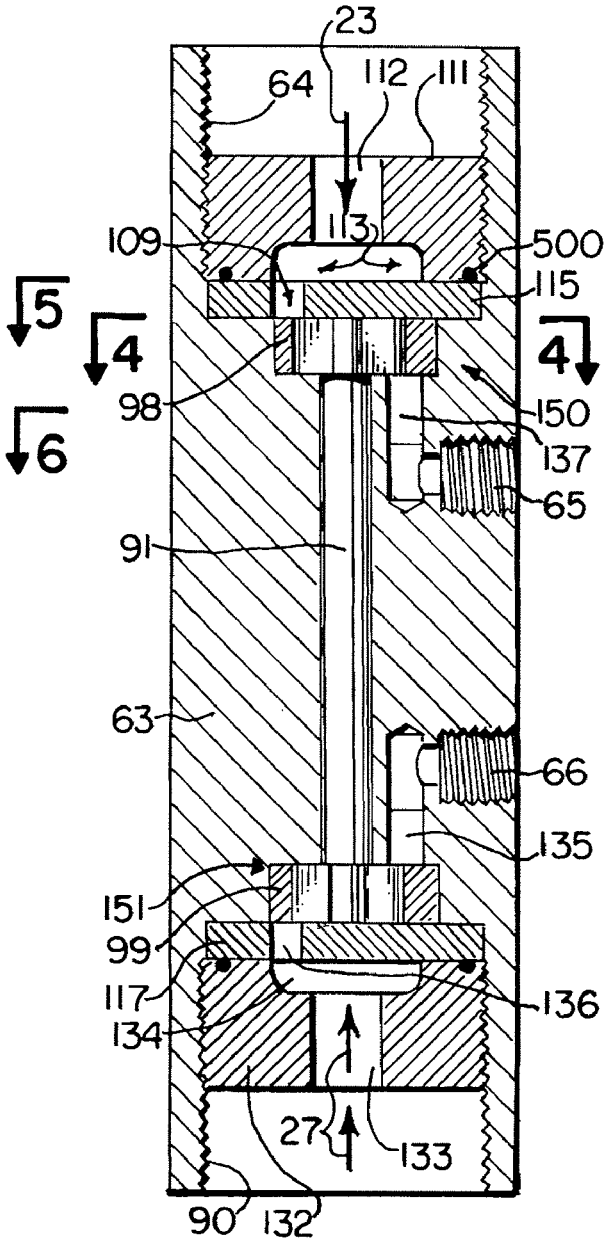
FIG. 3 is an enlarged fragmentary sectional view of the preferred embodiment of the apparatus of the present invention illustrating the pumping components.
Figure 4:
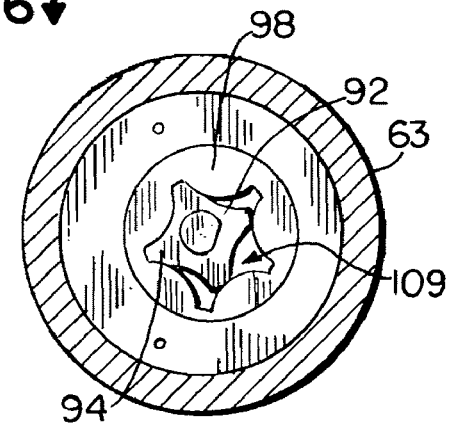
FIG. 4 is a sectional view taken along lines 4-4 of FIG. 3.
Figure 5:
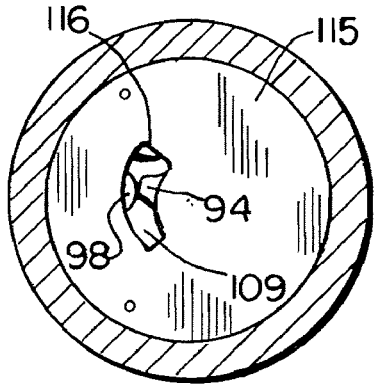
FIG. 5 is a sectional view taken along lines 5-5 of FIG. 3.
Figure 6:
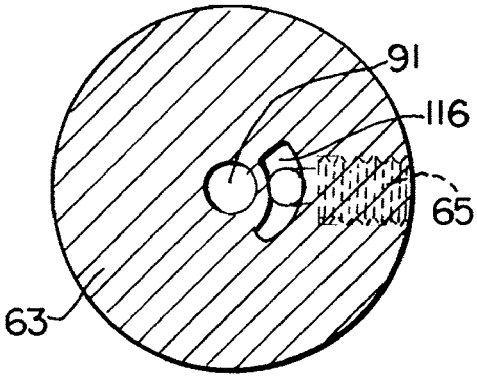
FIG. 6 is a section view taken along lines 6-6 of FIG. 3.

Oil well pump apparatus 10 as shown in the sectional elevation view of FIGS. 1A, 1B and 1C are in the lines A-A in FIGS. 1A and 1B are match lines and the lines B-B in FIGS. 1B and 1C are match lines. Oil well pump 10 is to be used in a well casing 11 that surrounds production tubing 12. A packer 13 is set in between casing 11 and production tubing 12 as shown in FIG. 1C. Landing nipple 14 is positioned above packer 13. The landing nipple 14 receives the lower end portion 17 of tool body 15 as shown in FIG. 1C. Tool body 15 can be pumped hydraulically (FIG. 11A) or lowered into the production tubing 12 bore 18 using a work string (not shown) that grips neck portion 32 at tool body 15 upper end 16.

Figure 11A:
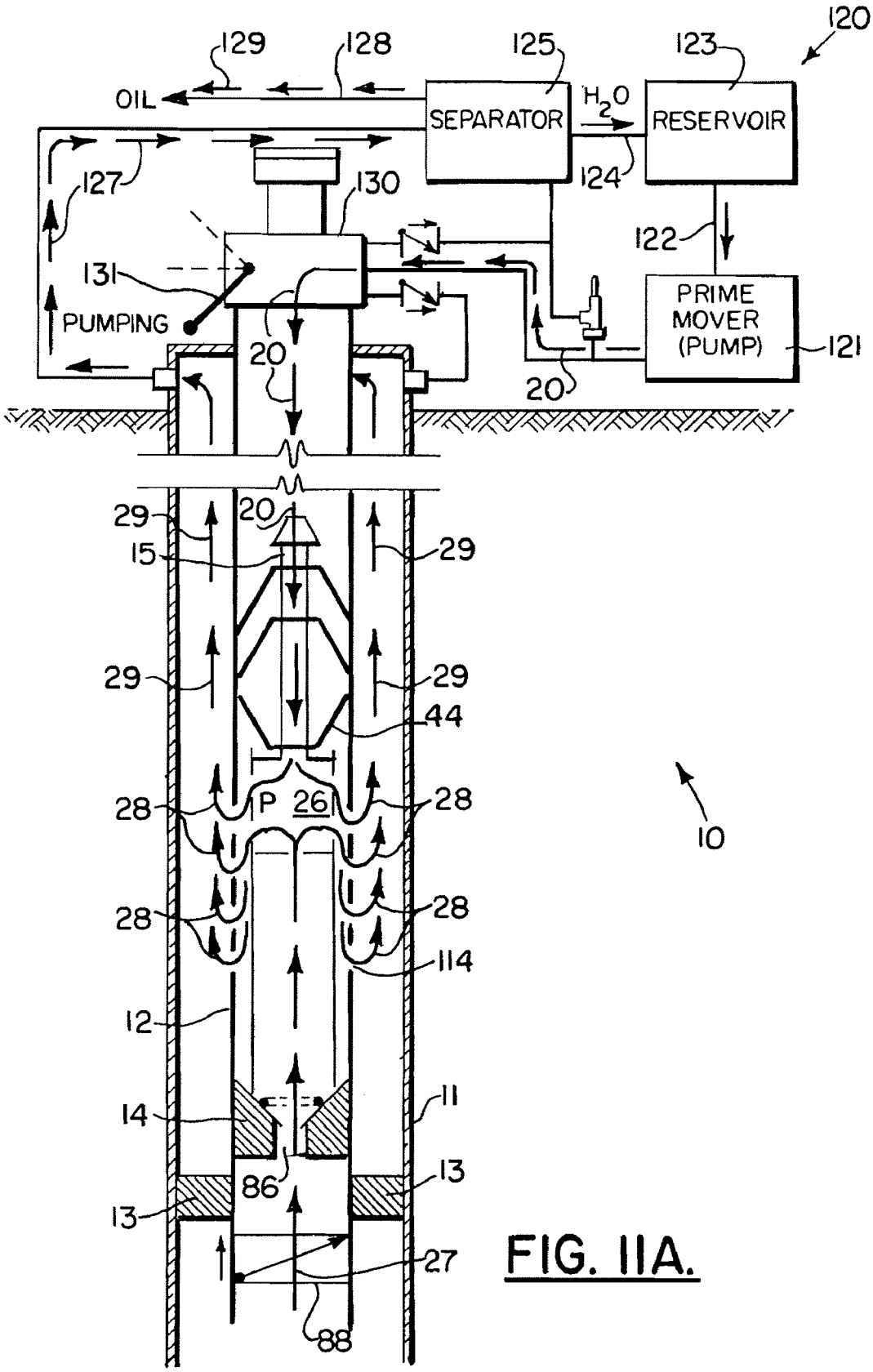
FIG. 11A is a schematic diagram showing operation of the apparatus and method of the present invention in a pumping position.

The apparatus 10 of the present invention provides an oil well pump 10 that has a tool body 15 that is elongated to fit inside of the bore 18 of production tubing 12 as shown in FIGS. 1A-1C. A well annulus 19 is that space in between casing 11 and production tubing 12. During use, a working fluid such as water, "lease" water, or an oil water mixture can be used to power pump mechanism 26. This working fluid follows the path that is generally designated by the arrows 20,21,22 and 23 in FIGS. 1A-1B. The working fluid is pumped from the wellhead area 120 using a prime mover 121 as shown in FIG. 11A and indicated by arrows 20.

Prime mover 121 can be a commercially available pump that receives working fluid via flowline 122 from reservoir 123. Reservoir 123 is supplied with the working fluid such as water via flowline 124 that exits oil/water separator 125.

As the working fluid is pumped by prime mover 121 in the direction of arrows 20 through production tubing 12, the working fluid enters tee-shaped passage 34 as indicated by arrows 21. The working fluid then travels in sleeve bore 36 of sleeve 35 as indicated by arrows 22 until it reaches connector 60 and its flow passages 67. Arrows 23 indicate the flow of the working fluid from the passages 67 to retainer 111 and its passageways 112, 113. At this point, the working fluid enters pump mechanism 26 (see FIGS. 1B, 2, and 3-6). A check valve 25 is provided that prevents oil from flowing in a reverse direction. This check valve 25 has a spring 50 that is overcome by the pressure of working fluid that flows through passageway 51 in the direction of arrows 20, 21, 22, 23. The working fluid exits tool body 15 via passageway 137 and working fluid discharge port 65 (see arrow 24).

The pump mechanism 26 is driven by the working fluid. The pump mechanism 26 also pumps oil from the well in the direction of oil flow arrows 27 as shown in FIGS. 1B, 1C and 11A. Connector 68 attaches to the lower end of pump mechanism housing 63. Connector 68 provides upper and lower external threads 69, 70 and flow passages 71 that enable oil to be produced to reach lower filter 31, suction ports 133, 134 of retainer 132 and lower gerotor device 151 so that the oil can be pumped by lower gerotor device 151 via passageway 135 to produced oil discharge port 66. At discharge port 66, the produced oil enters production tubing bore 18 where it commingles with the working fluid, the commingled mixture flowing into annulus 19 via perforations 114.

Figure 7B:
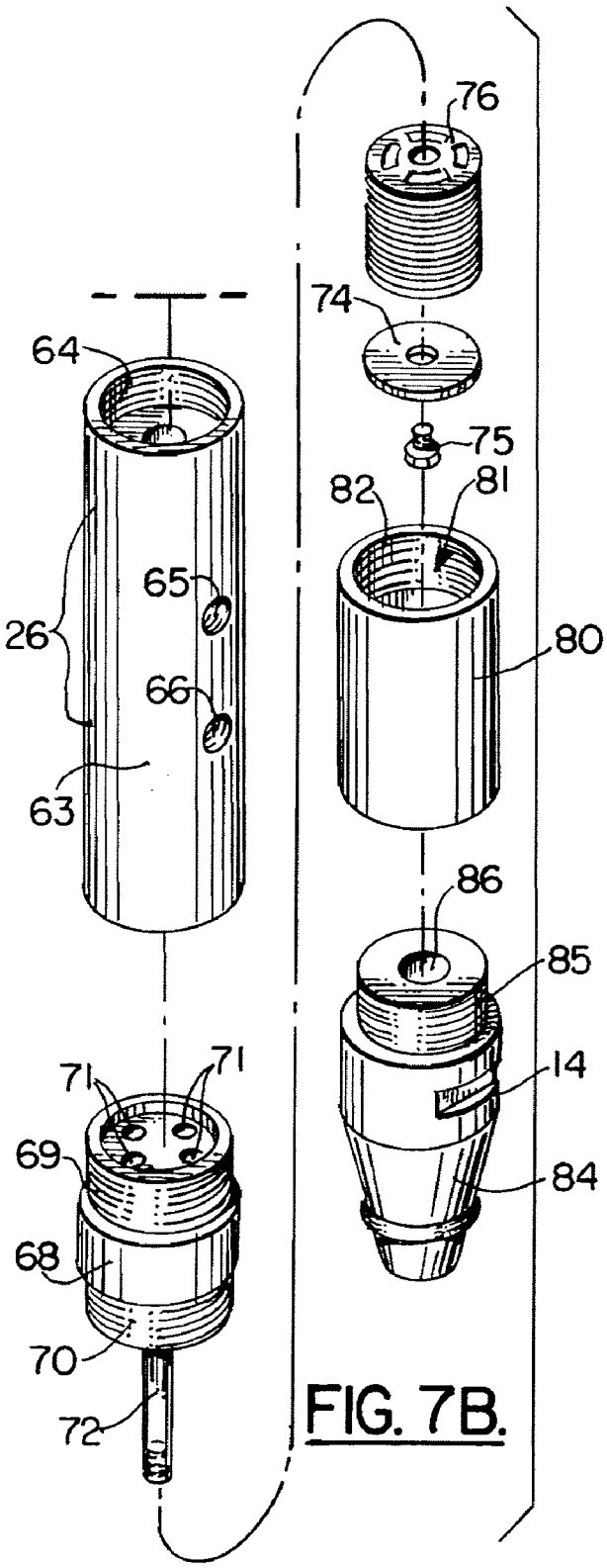
Figure 8:
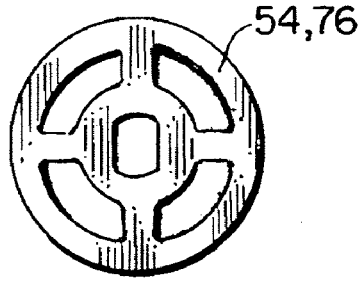
FIG. 8 is a fragmentary, top view of the preferred embodiment of the apparatus of the present invention illustrating one of the filtered disks.
Figure 9:
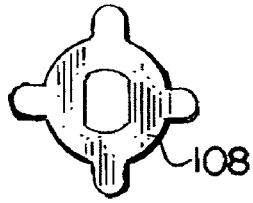
FIG. 9 is a fragmentary plan view of the preferred embodiment of the apparatus of the present invention illustrating a filter disk spacer.

Oil that flows from the producing formation in to the tool body (see arrows 27) flows upwardly via bore 86 of seating nipple 14. The lower end portion 17 of tool body 15 has a tapered section 84 that is shaped to fit seating nipple 14 as seen in FIG. 1C. An o-ring 87 on lower end 17 of tool body 15 forms a fluid seal between tool body 15 and seating nipple 14. Above passageway 86, oil is filtered with lower filter 31. Of similar construction to filter 30, filter 31 can be of alternating disks 76 and spacers 108 (FIGS. 8-9). Filter disk 76 are secured to connector 68 with shaft 72 having threaded connection 73 attaching to connector 68 while retainer plate 74 and bolt 75 hold filter disks 76 to shaft 72 (see FIGS. 1B, 7B and 8-9). Connector 68 attaches to pump mechanism housing 63 at threaded connection 78. Connector 68 attaches to sleeve 80 and its internal threads 82 at threaded connection 79. Sleeve 80 has bore 81 occupied by lower filter 31 (see FIGS. 1B and 7B). Seating nipple 14 attaches to the lower end of sleeve 80 with threaded connection 83. Seating nipple 14 has bore 86 and external threads 85 that connect to sleeve 80 at threaded connection 83.

Check valve 88 and its spring 89 prevent the working fluid from flowing into the formation that contains oil. The oil producing formation is below packer 13 and check valve 88. The producing oil enters the production tubing bore 18 via perforations (not shown) as is known in the art for oil wells. The check valve 88 is overcome by the pump 26 pressure as oil is pumped upwardly in the direction of arrows 27. The pump 26 includes two central impellers or rotors 94, 95. The upper central rotor 94 and outer rotor 98 are driven by the working fluid. The lower central rotor 95 and outer rotor 99 are connected to the upper rotor 94 with shaft 91 so that the lower central rotor 95 rotates when the upper rotor 94 is driven by the working fluid. Thus, driving the upper rotor 94 with the working fluid simultaneously drives the lower rotor 95 so that it pumps oil from the well production bore 18. The oil that is pumped mixes with the working fluid at perforations 114 in the production tubing as indicated schematically by the arrows 28, 29 in FIGS. 1A, 1B. The arrows 29 indicate the return of the oil/water mix in the annulus 19 that is in between casing 11 and production tubing 12.

In FIG. 11A, the oil, water (or other working fluid) mix is collected in flowline 126 and flows into oil/water separator 125 as indicated by arrows 127. Oil is then removed from the separator in flowline 128 as indicated by arrows 129 in FIG. 11A. The working fluid (e.g., water) is separated and flows via flowline 124 back into reservoir 123 for reuse as the working fluid.

As an alternate means to lower the tool body 15 into the well (if not using pumping of FIG. 11A), a neck section 32 is provided having an annular shoulder 33. This is common type of connector that is known in the oil field for lowering down hole tools into a well bore or as an alternate means of retrieval.

An upper filter 30 is provided for filtering the working fluid before it enters the pump mechanism 26. A lower filter 31 is provided for filtering oil before it enters the pump mechanism 26.

The tool body 15 includes a sleeve 35 that can be attached with a threaded connection 38 to the lower end portion of neck section 32 as shown in FIG. 1A. A pair of swab cups 37, 40 are attached to sleeve section 35 at spacer sleeve 42. The swab cup 37 provides an annular socket 39. The swab cup 40 provides an annular socket 41. The spacer sleeve 42 has a bore 43 that has an internal diameter that closely conforms to the outer surface of sleeve 35. The sleeve 35 provides bore 36 through which working fluid can flow as shown in FIGS. 1A and 1B. A third swab cup 44 is positioned just above valve housing 48 as shown in FIG. 1B. The swab cup 44 has an annular socket 47. A spacer sleeve 45 with bore 46 is sized to closely fit over sleeve 35 as shown in FIG. 1B.

Figure 7A:
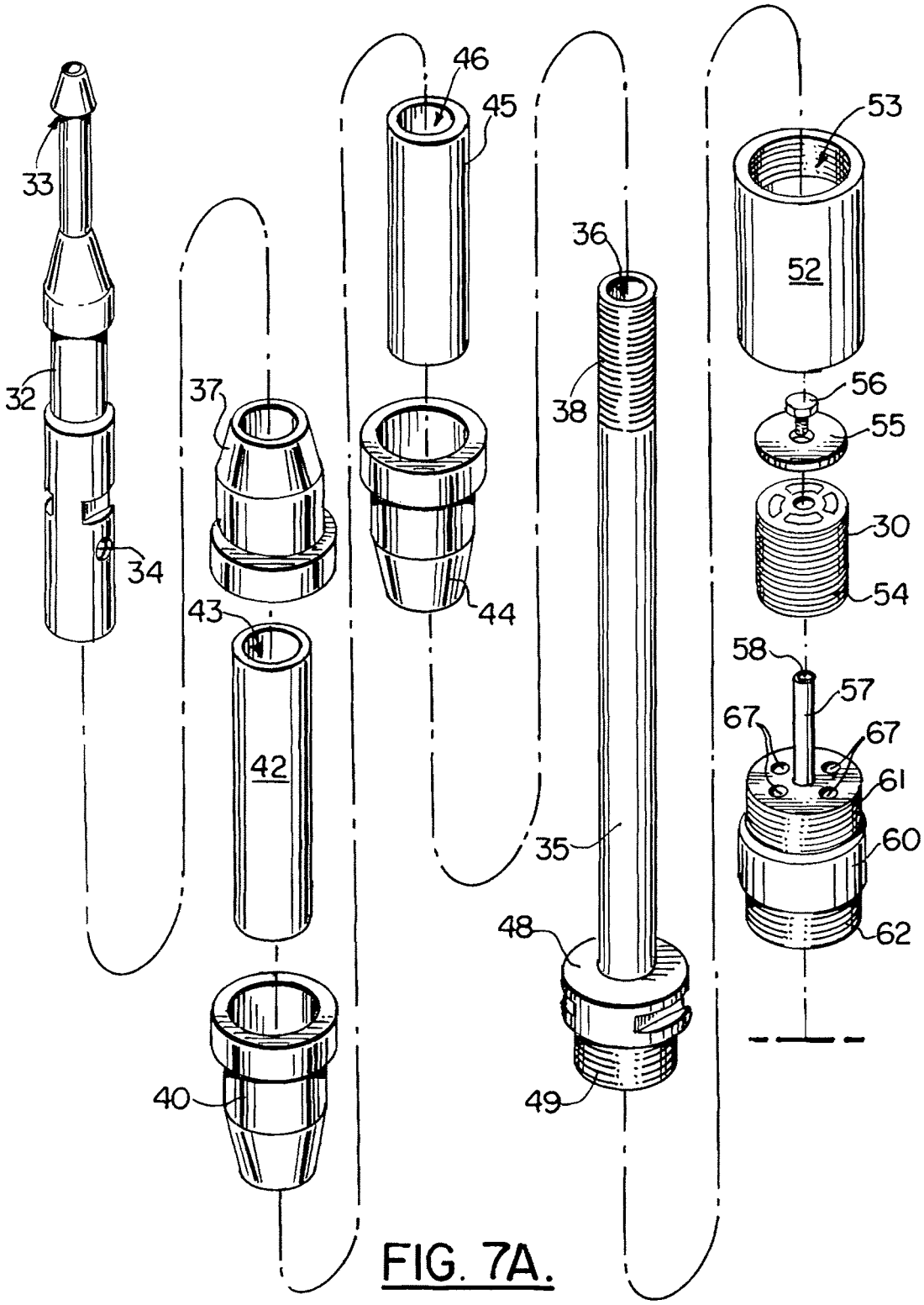
FIGS. 7A-7B are perspective views of the preferred embodiment of the apparatus of the present invention wherein the match line AA of FIG. 7A matches the match line AA of 7B.

Valve housing 48 has external threads that enable a threaded connection 49 to be formed with sleeve 52 at its bore 53 that is provided with internally threaded portions. The bore 53 of sleeve 52 carries filter 30 which is preferably in the form of a plurality of filter disks 54 separated by spacers 108 (see FIGS. 1B, 8-9). As shown in 7A, the filtered disks 54 of filter 30 are held in position upon shaft 57 with retainer plate 55 and bolt 56. Shaft 57 has an internally threaded portion 58 for receiving bolt 56 as shown in FIGS. 1B and 7A. A threaded connection 59 is formed between the lower end portion of shaft 57 and connector 60. The connector 60 has externally threaded portion 61, 62 and a plurality of longitudinally extending flow passages 71 as shown in FIGS. 1B and 7A.

The pump mechanism 26 (see FIGS. 1B, 2, 3) includes a pump housing 63 that is attached using a threaded connection to the bottom of connector 60 at thread 62. The pump housing 63 in FIG. 7B has internal threads 64 that enable connection with connector 60.

The housing 63 has a working fluid discharge port 65 and an oil discharge port 66 (see FIG. 3). Pump housing 63 carries shaft 91. The shaft 91 (see FIGS. 2 and 3) has keyed end portions 92, 93. Each rotor 94, 95 is provided with a correspondingly shaped opening so that it fits tightly to a keyed end portion 92 or 93 of shaft 91. In FIG. 2, the upper rotor 94 has a shaped opening 96 that fits the keyed end portion 92 of shaft 91. The rotor 95 has a shaped opening 97 that fits the keyed end portion 93 of shaft 91.

Each of the central rotors 94, 95 fits an outer rotor that has a star shaped chamber. In FIGS. 2 and 3, upper rotor 94 fits the star shaped chamber 109 of rotor 98. Similarly, the lower rotor 95 fits the star shaped chamber 110 of rotor 99.

Each rotor 94, 95 has multiple lobes (e.g., four as shown). The upper rotor 94 has lobes or gear teeth 100, 101, 102, 103. The lower rotor 95 has floor or gear teeth lobes 104, 105, 106, 107. This configuration of a star shaped inner or central rotor rotating in a star shaped chamber of an outer rotor having one more lobe than the central or inner rotor is a per se known pumping device known as a "gerotor". Gerotor pumps are disclosed, for example, in U.S. Pat. No. 3,273,501; 4,193,746, 4,540,347; 4,986,739; and 6,113,360 each hereby incorporated herein by reference.

Figure 10A:
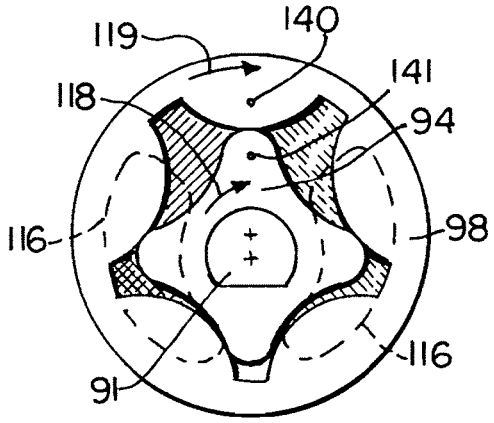
FIGS. 10A-10E are sequential illustrations that show various positions of the gerotor devices for both the upper and lower gerotors.
Figure 10B:
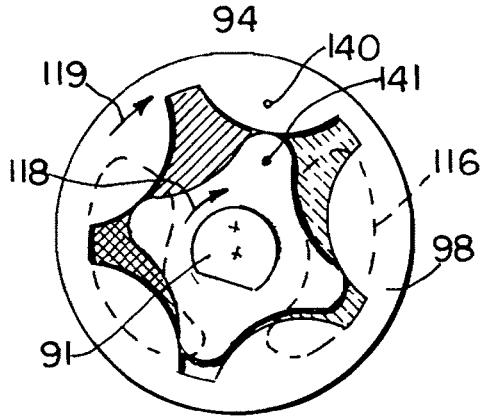
Figure 10C:
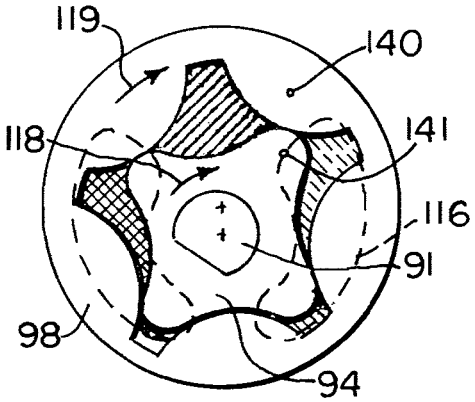
Figure 10D:
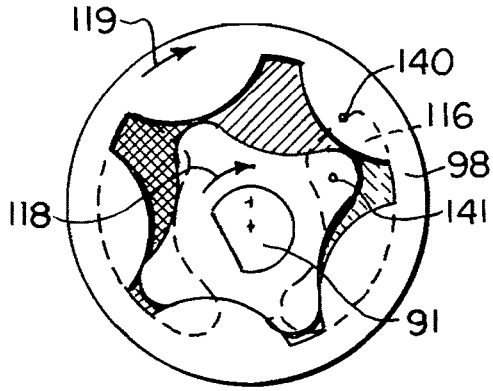
Figure 10E:
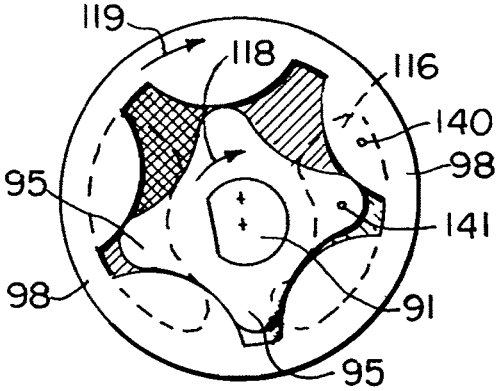

Working fluid that flows downwardly in the direction of arrow 23 enters the enlarged chamber 113 part of passageway 112 of retainer 111 so that the working fluid can enter any part of the star shaped chamber 109 of upper disk 98. An influent plate 115 is supported above upper disk 98 and provides a shaped opening 116. When the working fluid is pumped from enlarged section 113 into the star shaped chamber 109 that is occupied by upper rotor 94, both rotors 94 and 98 rotate as shown in FIGS. 10A-10E to provide an upper gerotor device 150. FIGS. 10A-10E show a sequence of operation during pumping of the upper central rotor 94 in relation to upper outer rotor 98 and its star shaped chamber 109. In FIG. 10A, the opening 116 is shown in position relative to rotors 94 and 98. The two reference dots 140, 141 are aligned in the starting position of FIG. 10A. Arrow 118 indicates the direction of rotation of rotor 94. Arrow 119 indicates the direct of rotation of upper disk 98. By inspecting the position of the reference dots 140, 141 in each of the views 10A-10E, the pumping sequence can be observed.

The two gerotor devices 150, 151 provided at the keyed end portions 92, 93 of shaft 91 each utilize an inner and outer rotors. At shaft upper end 92, upper inner rotor 94 is mounted in star shaped chamber 109 of peripheral rotor 98. As the inner, central rotor 94 rotates, the outer rotor 98 also rotates, both being driven by the working fluid that is pumped under pressure to this upper gerotor 150.

The rotor or impeller 94 rotates shaft 92 and lower inner rotor or impeller 95. As rotor 95 rotates with shaft 92, outer peripheral rotor 99 also rotates, pulling oil upwardly in the direction of arrows 27. Each inner, central rotor 94, 95 has one less tooth or lobe than its associated outer rotor 98, 99 respectively as shown in FIGS. 2 and 10A-10E. While FIGS. 10A-10E show upper rotors 94, 98, the same configuration of FIGS. 10A-10E applies for lower rotors 95, 99. An eccentric relationship is established by the parallel but nonconcentric axes of rotation of rotors 94, 98 so that full tooth or lobe engagement between rotors 94, 98 occurs at a single point only (see FIGS. 10A-10E).

As working fluid flows through passageways 112, 113 into star shaped chamber 109 and shaped opening 116, rotors 94, 98 rotate as do rotors 95, 99. Oil to be produced is drawn through suction ports 133, 134 of retainer 132 to shaped opening 136 of effluent plate 117 and then into star shaped chamber 110 of outer rotor 99. The rotating rotors 95, 99 transmit the oil to be pumped via passageway 135 to oil discharge port 66.

At discharge port 66, oil to be produced mixes with the working fluid and exits perforations 114 in production tub 12 as indicated by arrows 28 in FIG. 1B.

In the pumping mode of FIG. 11A, working fluid (e.g., water) moves from the reservoir 123 to the prime mover 121. The prime mover 121 can be a positive displacement pump that pumps the working fluid through three way valve 130. In the pumping mode, three way valve 130 handle 131 is in the down position as shown in FIG. 11A, allowing the working fluid or power fluid into the tubing 12. The working fluid pumps the tool body 15 into the seating nipple 14 and then the lower swab cups 40, 44 flare outwardly sealing against the tubing 12 causing the power fluid to then enter the ports or channel 34 at the upper end 16 of the tool body 15. The working fluid travels through the center of the stacked disk upper filter 30 into the uppermost gerotor motor 150 causing the upper gerotor 150 to rotate and, in turn, causing the shaft 92 to rotate which causes the lower gerotor 151 to turn.

When the lower gerotor 151 turns, it pumps produced oil into the casing annulus 19 so that it commingles (arrows 28) with the working fluid and returns to the surface. At the surface or wellhead 120, the oil/water separator 125 separates produced oil into a selected storage tank and recirculates the power fluid into the reservoir to complete the cycle.

Figure 11B:
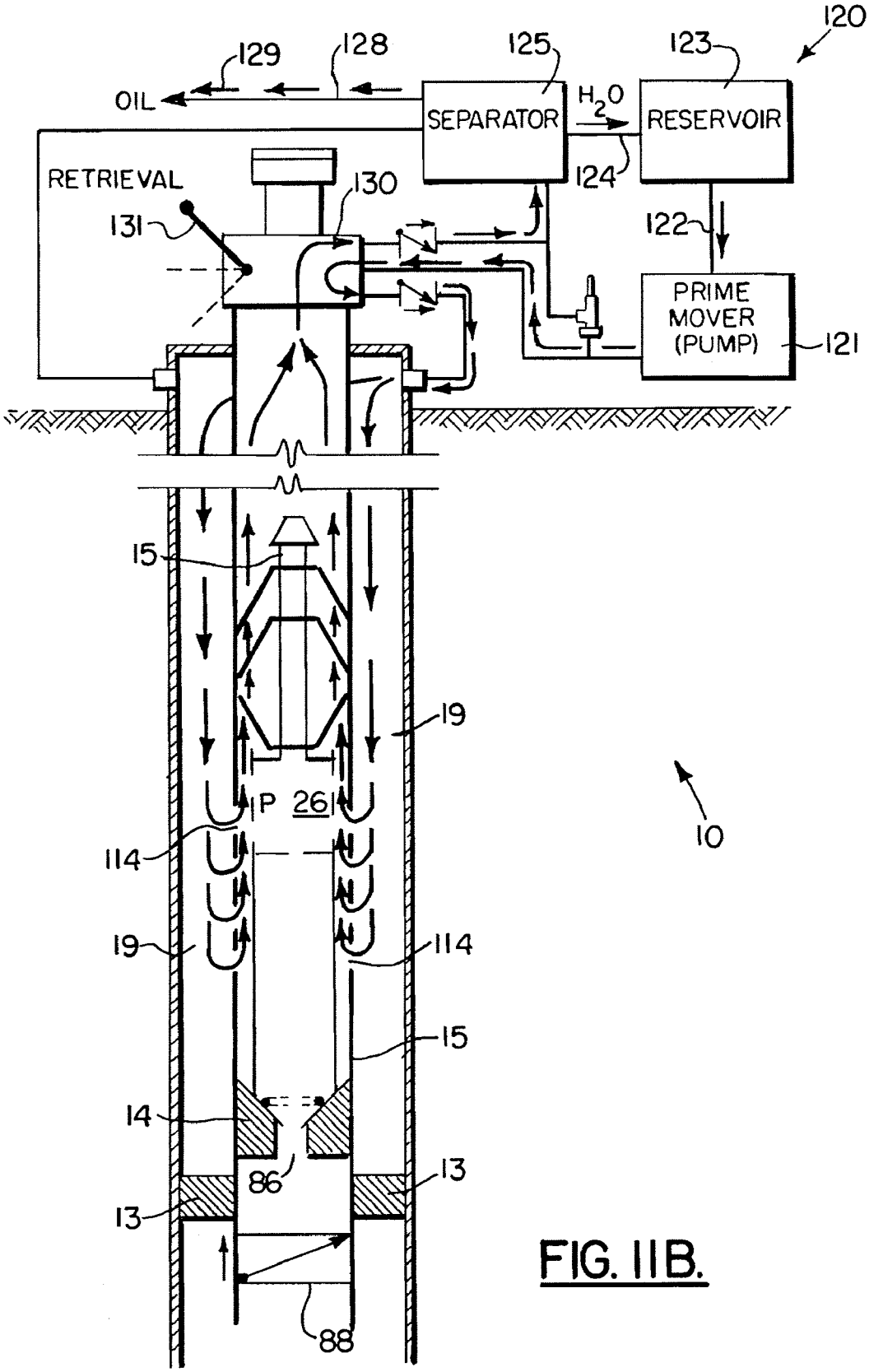
FIG. 11B is a schematic diagram showing operation of the apparatus and method of the present invention in a retrieval position.

In the retrieval mode of FIG. 11B, working fluid moves from the reservoir 123 to the prime mover 121. The positive displacement prime mover 121 pumps the working fluid through the three way valve 130. In the retrieval mode, the three way valve handle 131 is in an upper position (as shown in FIG. 11B) that allows the working fluid to enter the casing annulus 19. The working fluid enters the perforated production tubing 12 at perforations 114 but does not pass the packer 13. This working fluid that travels in the annulus 19 flares the upper swab cup 37 against the production tubing 12 causing a seal. The tool body 15 provides a check valve 88 to prevent circulation of the working fluid through the tool body 15 to the oil producing formation that is below valve 88 and packer 13. This arrangement causes the tool body 15 to lift upward and return to the wellhead 120 where it can be removed using an overshot. In FIG. 11B, the tool body 15 can thus be pumped to the surface or wellhead area 120 for servicing or replacement. The power fluid or working fluid circulates through the three way valve 130 to the oil separator 125 and then to the reservoir 123 completing the cycle.

Figure 11C:
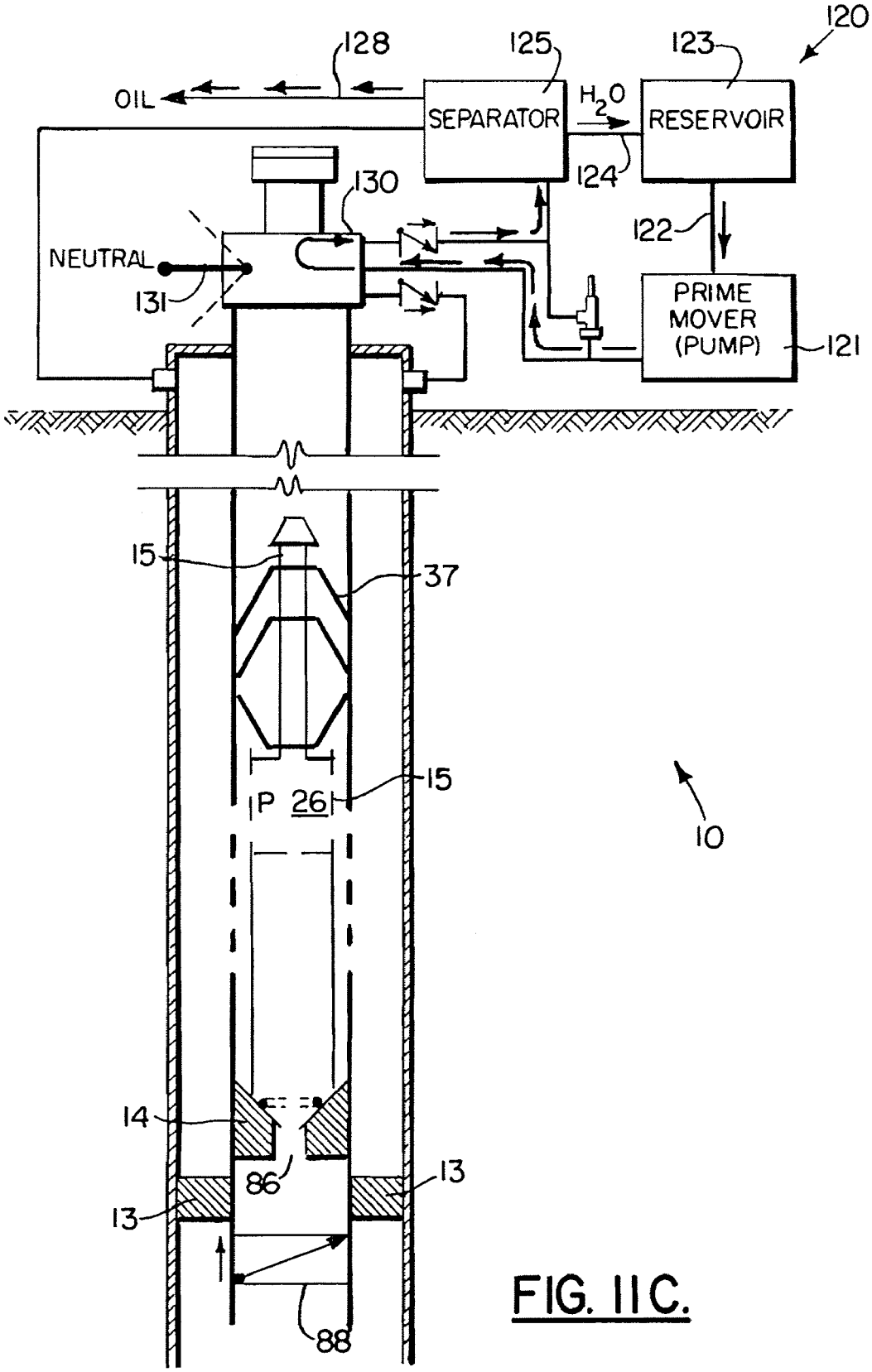
FIG. 11C is a schematic diagram showing operation of the apparatus and method of the present invention in a neutral position

In FIG. 11C, a neutral mode is shown. When the tool body 15 is captured with an overshot, for example, the three way valve 130 is placed in a middle or neutral position as shown in FIG. 11C. The FIG. 11C configuration causes the power fluid or working fluid to circulate through the three way valve 130 and directly to the separator 125 and then back to the reservoir 123. The configuration of FIG. 11A produces zero pressure on the tubing 12. Ahammer union can be loosened to remove the tool body 15 and release the overshot. The tool body 15 can be removed for servicing or replacement. A replacement pump can then be placed in the tubing 12 bore 18. A well operator then replaces the hammer union and places the handle 131 of the three way valve 130 in the down position of FIG. 11A. The tool body 15 is then pumped to the seating nipple 14 as shown in FIG. 11A, seating in the seating nipple 14 so that oil production can commence.

PARTS LIST

The following is a list of suitable parts and materials for the various elements of the preferred embodiment of the present invention.

10 oil well pump
11 casing
12 production tubing
13 packer
14 seating nipple
15 tool body
16 upper end portion
17 lower end portion
18 bore

19 annulus
20 arrow
21 arrow
22 arrow
23 arrow
24 arrow
25 check valve
26 pump mechanism
27 oil flow arrow
28 oil mix flow arrow
29 return flow arrow
30 filter, upper
31 filter, lower
32 neck section
33 annular shoulder
34 channel
35 sleeve
36 sleeve bore
37 swab cup
38 threaded connection
39 annular socket
40 swab cup
41 annular socket
42 spacer sleeve
43 bore
44 swab cup
45 spacer sleeve
46 bore
47 annular socket
48 valve housing
49 threaded connection
50 spring
51 passageway
52 sleeve
53 bore
54 filter disk
55 retainer plate
56 bolt
57 shaft
58 internal threads
59 threaded connection
60 connector
61 external threads
62 external threads
63 pump mechanism housing
64 internal threads
65 working fluid discharge port
66 produced oil discharge port
67 flow passage
68 connector
69 external threads
70 external threads
71 flow passage
72 shaft
73 threaded connection
74 retainer plate
75 bolt
76 filler disk
78 threaded connection
79 threaded connection
80 sleeve
81 bore
82 internal threads
83 threaded connection
84 tapered section
85 external threads
86 bore
87 o-ring
88 check valve
89 spring
90 internal threads
91 shaft
92 keyed portion
93 keyed portion
94 upper rotor
95 lower rotor
96 shaped opening
97 shaped opening
98 outer rotor
99 outer rotor
100 lobe
101 lobe
102 lobe
103 lobe
104 lobe
105 lobe
106 lobe
107 lobe
108 spacer
109 star shaped chamber
110 star shaped chamber
111 retainer
112 passageway
113 enlarged section
114 perforations
115 influent plate
116 shaped opening
117 effluent plate
118 arrow
119 arrow
120 wellhead area
121 prime mover
122 flowline
123 reservoir
124 flowline
125 separator
126 flowline
127 arrow
128 flowline
129 arrow
130 three way valve
131 handle
132 retainer
133 suction port
134 suction port
135 passageway
136 shaped opening
137 passageway
140 reference dot
141 reference dot
150 upper gerotor device
151 lower gerotor device The foregoing embodiments are presented by way of example only; the scope of the present invention is to be limited only by the following claims.

The invention claimed is:

1. An oil pump apparatus for pumping oil from an oil well having a wellhead and a well bore with casing and a production tubing string, comprising:

a) a tool body that is sized and shaped to be lowered into the production tubing string of an oil well;

b) a casing and production tubing;

c) a working fluid that can be pumped into the production tubing:

d) a prime mover for pumping the working fluid;

e) a flow channel in the well bore that enables the working fluid to be circulated from the prime mover via the production tubing to the tool body at a location in the well and then back to the wellhead area;

f) a pumping mechanism on the tool body, the pumping mechanism including a first impeller that is driven by the working fluid and a second impeller that is rotated by the first impeller, the second impeller pumping oil from the well via the tool body;

g) wherein the working fluid flows downwardly through the first impeller;

h) wherein the tool body has flow conveying portions that mix the working fluid and the oil as the oil is pumped; and i) wherein the pumping mechanism transmits the commingled fluid of oil and working fluid to the wellhead area.

2. The oil pump apparatus of claim 1 further comprising a filter in the tool body that is positioned to filter the working fluid before it reaches the pumping mechanism.

3. The oil pump apparatus of claim 1 further comprising a filter in the tool body that is positioned to filter the oil being pumped before it reaches the pumping mechanism.

4. The oil pump apparatus of claim 1 wherein the working fluid is water or oil or a mixture of oil and water.

5. The oil pump apparatus of claim 1 wherein the working fluid is a fluid or oil or a mixture of oil and water.

6. The oil pump apparatus of claim 1 wherein the working fluid is oil.

7. The oil pump apparatus of claim 1 wherein the impellers include upper and lower impellers connected by only one common shaft.

8. The oil pump apparatus of claim 1 wherein the pumping mechanism includes upper and lower gerotor mechanisms, each gerotor mechanism having an inner rotor having multiple lobes that interfaces with an outer rotor having more lobes than the inner rotor.

9. An oil pump apparatus for pumping oil from an oil well having a wellhead and a well bore with casing and a production tubing string, comprising:

a) a tool body that is sized and shaped to be lowered into the production tubing string of an oil well;

b) a casing and production tubing;

c) a working fluid that can be pumped into the production tubing;

d) a prime mover for pumping the working fluid;

e) a flow channel in the well bore that enables the working fluid to be circulated from the prime mover via the production tubing to the tool body at a location in the well and then back to the wellhead area;

f) a pumping mechanism on the tool body, the pumping mechanism including a first impeller that is driven by the working fluid and a second impeller that is rotated by the first impeller, the second impeller pumping oil from the well via the tool body;

g) wherein the tool body has flow conveying portions that mix the working fluid and the oil as the oil is pumped;

h) wherein the pumping mechanism transmits the commingled fluid of oil and working fluid to the wellhead area; and i) a swab cup on the tool body that enables the tool body to be pumped to the well head area using the working fluid.

10. The oil pump apparatus of claim 9 further comprising a swab cup on the tool body that enables the tool body to be pumped into the well bore via the production tubing string using the working fluid.

11. An oil pump apparatus for pumping oil from an oil well having a wellhead and a well bore with casing and a production tubing string, comprising:

a) a tool body that is sized and shaped to be lowered into the production tubing string of an oil well:

b) a casing and production tubing;

c) a working fluid that can be pumped into the production tubing;

d) a prime mover for pumping the working fluid:

e) a flow channel in the well bore that enables the working fluid to be circulated from the prime mover via the production tubing to the tool body at a location in the well and then back to the wellhead area;

f) a pumping mechanism on the tool body, the pumping mechanism including a first impeller that is driven by the working fluid and a second impeller that is rotated by the first impeller, the second impeller pumping oil from the well via the tool body;

g) wherein the tool body has flow conveying portions that mix the working fluid and the oil as the oil is pumped;

h) wherein the pumping mechanism transmits the commingled fluid of oil and working fluid to the wellhead area; and i) a swab cup on the tool body that enables the tool body to be pumped into the well bore via the production tubing string using the working fluid.

12. The oil pump apparatus of claim 11 further comprising a swab cup on the tool body that enables the tool body to be pumped to the well head area using the working fluid.

13. An oil pump apparatus for pumping oil from an oil well having a wellhead and a well bore with casing and a production tubing string, comprising:

a) a tool body that is sized and shaped to be lowered into the production tubing string of an oil well;

b) a casing and production tubing;

c) a working fluid that can be pumped into the production tubing:

d) a prime mover for pumping the working fluid;

e) a flow channel in the well bore that enables the working fluid to be circulated from the prime mover via the production tubing to the tool body at a location in the well and then back to the wellhead area;

f) a pumping mechanism on the tool body, the pumping mechanism including a first impeller that is driven by the working fluid and a second impeller that is rotated by the first impeller, the second impeller pumping oil from the well via the tool body;

g) wherein the tool body has flow conveying portions that mix the working fluid and the oil as the oil is pumped;

h) wherein the pumping mechanism transmits the commingled fluid of oil and working fluid to the wellhead area; and i) a check valve positioned on the tool body above the pumping mechanism that prevents oil flow inside the tool body above the pumping mechanism.

14. An oil pump apparatus for pumping oil from an oil well having a wellhead and a well bore with casing and a production tubing string, comprising:

a) a tool body that is sized and shaped to be lowered into the production tubing string of an oil well;

b) a casing and production tubing;

c) a working fluid that can be pumped into the production tubing;

d) a prime mover for pumping the working fluid;

e) a flow channel in the well bore that enables the working fluid to be circulated from the prime mover via the production tubing to the tool body at a location in the well and then back to the wellhead area;

f) a pumping mechanism on the tool body, the pumping mechanism including a first impeller that is driven by the working fluid and a second impeller that is rotated by the first impeller, the second impeller pumping oil from the well via the tool body;

g) wherein the tool body has flow conveying portions that mix the working fluid and the oil as the oil is pumped;

h) wherein the pumping mechanism transmits the commingled fluid of oil and working fluid to the wellhead area; and i) a check valve positioned below the pumping mechanism that prevents the flow of the working fluid inside the tool body to a position below the tool body.

15. An oil pump apparatus for pumping oil from an oil well having a wellhead and a well bore with casing and a production tubing string, comprising:

a) a tool body that is sized and shaped to be lowered into the production tubing string of an oil well;

b) a casing and production tubing;

c) a working fluid that can be pumped into the production tubing;

d) a prime mover for pumping the working fluid;

e) a flow channel in the well bore that enables the working fluid to be circulated from the prime mover via the production tubing to the tool body at a location in the well and then back to the wellhead area;

f) a pumping mechanism on the tool body, the pumping mechanism including a first gerotor device that is driven by the working fluid and a second gerotor device that is powered by the first gerotor device, the second gerotor device pumping oil from the well via the tool body, each gerotor device having an inner rotor having multiple lobes that interfaces with an outer rotor having more lobes than the inner rotor;

g) wherein the tool body has flow conveying portions that mix the working fluid and the oil as the oil is pumped; and h) wherein the pumping mechanism transmits the commingled fluid of oil and working fluid to the wellhead area.

16. The oil pump apparatus of claim 15 further comprising a filter in the tool body that is positioned to filter the working fluid before it reaches the pumping mechanism.

17. The oil pump apparatus of claim 15 further comprising a filter in the tool body that is positioned to filter the oil being pumped before it reaches the pumping mechanism.

18. The oil pump apparatus of claim 15 wherein the working fluid is water or oil or a mixture of oil and water.

19. The oil pump apparatus of claim 15 wherein the working fluid is a fluid mixture of oil and water.

20. The oil pump apparatus of claim 15 wherein the working fluid is oil.

21. The oil pump apparatus of claim 15 further comprising a swab cup on the tool body that enables the tool body to be pumped to the well head area using the working fluid.

22. The oil pump apparatus of claim 15 further comprising a swab cup on the tool body that enables the tool body to be pumped into the well bore via the production tubing string using the working fluid.

23. The oil pump apparatus of claim 15 further comprising a check valve positioned on the tool body above the pumping mechanism that prevents oil flow inside the tool body above the pumping mechanism.

24. The oil pump apparatus of claim 15 further comprising a check valve positioned below the pumping mechanism that prevents the flow of the working fluid inside the tool body to a position below the tool body.

25. The oil pump apparatus of claim 15 wherein the impellers include upper and lower impellers connected by only one common shaft.

* * * * *